US010300735B2

(12) United States Patent
Mullins

(10) Patent No.: US 10,300,735 B2
(45) Date of Patent: May 28, 2019

(54) FRAMING TOOL ADAPTABLE FOR USE WITH A FRAMING SQUARE

(71) Applicant: Earl Anthony Mullins, Mount Hope, WV (US)

(72) Inventor: Earl Anthony Mullins, Mount Hope, WV (US)

( * ) Notice: Subject to any disclaimer, the term of this patent is extended or adjusted under 35 U.S.C. 154(b) by 174 days.

(21) Appl. No.: 15/680,358

(22) Filed: Aug. 18, 2017

(65) Prior Publication Data

US 2019/0054758 A1 Feb. 21, 2019

(51) Int. Cl.

| | |
|---|---|
| ***B43L 7/14*** | (2006.01) |
| ***B43L 7/00*** | (2006.01) |
| ***E04G 21/16*** | (2006.01) |
| ***B43L 7/027*** | (2006.01) |

(52) U.S. Cl.
CPC ..... *B43L 7/007* (2013.01); *B43L 7/0275* (2013.01); *E04G 21/16* (2013.01)

(58) Field of Classification Search
CPC ..... B43L 7/007; B43L 7/0275
USPC ..... 33/427, 428, 430
See application file for complete search history.

(56) References Cited

U.S. PATENT DOCUMENTS

| | | | | |
|---|---|---|---|---|
| 35,159 A | | 5/1862 | Iseman | |
| 136,653 A | | 3/1873 | Hyman | |
| 168,656 A | | 10/1875 | McInnes | |
| 327,283 A | | 9/1885 | Levy | |
| 638,446 A | | 12/1899 | Dean | |
| 666,346 A | | 1/1901 | Goelzer | |
| 792,212 A | | 6/1905 | Heddle | |
| 800,964 A | * | 10/1905 | Winship | B43L 7/0275 33/476 |
| 935,067 A | * | 9/1909 | Taylor | B25H 7/04 33/42 |
| 1,189,983 A | | 7/1916 | McLeod | |
| 1,301,166 A | | 4/1919 | Potter | |

(Continued)

FOREIGN PATENT DOCUMENTS

WO 2004109221 A2 12/2004

OTHER PUBLICATIONS

Website: http://www.contractortalk.com/f50/stair-gauges-117766/index4/ Downloaded Jan. 26, 2017 Stair Gauges.

(Continued)

*Primary Examiner* — George B Bennett
(74) *Attorney, Agent, or Firm* — Russ Weinzimmer & Associates, P.C.

(57) ABSTRACT

A framing tool includes a pair of slotted beams that are affixed together at each end using an end spacer of a thickness selected to maintain the two slotted beams at a separation that allows a framing square to slide easily but snugly therebetween. Then, a user can cause the slotted beams to clamp down on the framing square using two sliding clamps so as to trap the framing square between the two slotted beams. The first sliding clamp is slidable along a slot of the pair of slotted beams, and the second sliding clamp is slidable along a slot of the pair of slotted beams. The framing tool also includes: a pair of end-fixed spacer assemblies, a first end-fixed spacer assembly configured to squeeze together the first ends against an end spacer, and a second end-fixed spacer assembly configured to squeeze together the second ends against an end spacer.

20 Claims, 3 Drawing Sheets

(56) References Cited

U.S. PATENT DOCUMENTS

| | | | | | |
|---|---|---|---|---|---|
| 2,458,188 | A * | 1/1949 | Moran | B43L 7/005 | 33/430 |
| 2,499,721 | A | 3/1950 | Cassity | | |
| 2,705,029 | A * | 3/1955 | Zophel | B25H 1/0078 | 144/1.1 |
| 2,846,143 | A | 8/1958 | Birkness et al. | | |
| 2,908,080 | A | 10/1959 | Varbel | | |
| 3,089,245 | A * | 5/1963 | Cromer | B43L 7/005 | 33/27.03 |
| 3,289,301 | A | 12/1966 | Hanson | | |
| 3,478,434 | A | 11/1969 | Catalano | | |
| 3,827,685 | A | 8/1974 | Wennes | | |
| 4,157,819 | A | 6/1979 | Meyer | | |
| 4,420,891 | A | 12/1983 | Orem | | |
| 4,688,333 | A * | 8/1987 | Welch | B41K 1/06 | 33/1 AA |
| 4,761,890 | A | 8/1988 | Morrell | | |
| 5,446,969 | A | 9/1995 | Terenzoni | | |
| 5,669,149 | A | 9/1997 | Meitzler | | |
| 7,197,833 | B1 | 4/2007 | Ekern | | |
| 7,343,688 | B2 | 3/2008 | Price | | |
| 7,854,070 | B1 | 12/2010 | Vajentic | | |
| 9,121,688 | B1 | 9/2015 | Schmid | | |
| 2004/0181955 | A1 | 9/2004 | Sargent | | |
| 2004/0216316 | A1 | 11/2004 | Ellis et al. | | |
| 2012/0285028 | A1 | 11/2012 | Atwood | | |
| 2012/0311880 | A1 * | 12/2012 | Doggett | B43L 7/14 | 33/452 |
| 2015/0191039 | A1 * | 7/2015 | Johnson | B43L 7/14 | 33/427 |

OTHER PUBLICATIONS

Website: http://www.finehomebuilding.com/2003/01/01/adjustablestair-jig Downloaded Jan. 26, 2017 Stair jig with an adjustable fence.
Website: https://www.amazon.com/Trend-STAIR-Staircase-Housing-Closed/dp/B0001P124W Downloaded Jan. 26, 2017 Trend STAIR/A Staircase-Housing Jig for Closed Riser.
Website: http://s1112.photobucket.com/user/oldgrumpy2/media/stairguage.jpg.html Downloaded Jan. 26, 2017 Slotted stair gauge.
Website video: https://www.youtube.com/watch?v=yFQYIYstC18 Downloaded Jan. 26, 2017 Refter and stair layout square.

* cited by examiner

FRAMING TOOL ADAPTABLE FOR USE WITH A FRAMING SQUARE

FIELD OF THE INVENTION

This invention relates generally to carpentry tools, and more particularly to framing tools, such as used for roof framing, stair building, and brace framing.

BACKGROUND OF THE INVENTION

Many of the known devices require the use of a special framing tool (also called a carpenter's square), either slotted or set for a certain thickness. For example, U.S. Pat. No. 327,283 requires the use of a special slotted carpenter's square, so any purchaser of this device cannot use a carpenter's square already in his possession.

SUMMARY OF THE INVENTION

The framing tool of the invention includes a pair of slotted beams that are affixed together at each end using an annular spacer of a thickness selected to maintain the two slotted beams at a separation all along the beams that allows a particular selected framing square to slide easily but snugly between the two slotted beams.

Thus, the framing tool of the invention can accommodate any framing square (also called a "carpenter's square") using two spacers selected to be slightly thicker than most available framing squares.

For example, an embodiment of the framing tool of the invention can include two ¾ inch thick slotted beams, plus a spacer (e.g., ⅛ inch) so as to accommodate a carpenter's square between the slotted beams, making it 1 ⅝ inch total thickness. The slotted beams can be made of extruded aluminum for durability and flexibility. Other materials can be used to make the slotted beams, such as wood, or steel, or plastic.

The framing tool also includes two sliding clamps, each sliding clamp being slidable along one or more slots of the slotted beams to selectable positions between the ends of the pair of slotted beams. Each sliding clamp can squeeze the two slotted beams together to trap the framing square between the two slotted beams at a position and at an orientation chosen so as to create a desired angle between the framing square and the framing tool.

For example, each sliding clamp can be a nut and a bolt, or can be a nut, bolt, and block spacer to make the nut more accessible. When each bolt is secured with its wing nut, the bolt will not slide. Further, when each bolt is secured by its wing nut, the slotted beams are pulled together, thereby trapping the framing square between the two slotted beams, which serves to secure the framing square at a desired position and orientation as needed by the carpenter using the framing tool of the invention.

To use the framing tool with a carpenter's square, the carpenter's or framing square is first inserted between the two slotted beams. Then, the carpenter's square is moved into the desired position and orientation. Next, the carpenter's square is secured using the sliding bolts and wing nuts so as to provide two fixed angles that can be used to mark off cuts on lumber, for example.

A general aspect of the invention is a framing tool including: a pair of slotted beams each having a first end and a second end, each slotted beam having one or more slots; a pair of end spacers, one end spacer being sandwiched between the pair of slotted beams at each end, each end spacer being of a thickness configured to maintain a separation distance at each end of the pair of slotted beams substantially similar to a thickness of a framing square; and two sliding clamps, a first sliding clamp being slidable along a slot of the pair of slotted beams, a second sliding clamp being slidable along a slot of the pair of slotted beams, each sliding clamp being configured to be able to squeeze the two slotted beams together so as to trap the framing square between the two slotted beams.

In some embodiments, each end spacer of the pair of end spacers includes a bolt hole, and each slotted beam includes a bolt hole at each of the first and second ends thereof, the framing tool further including: a first bolt extending through the bolt hole of a first end spacer, and through a bolt hole in a first end of each slotted beam of the pair of slotted beams; a first nut cooperative with the first bolt, the first nut being configured to press each of the first ends against the first end spacer; a second bolt extending through the bolt hole of a second end spacer, and through a bolt hole in a second end of each slotted beam of the pair of slotted beams; a second nut cooperative with the second bolt, the second nut being configured to press each of the second ends against the second end spacer.

In some embodiments, the framing tool further includes: a washer cooperative with each of the first and second nuts.

In some embodiments, each end spacer is an annular end spacer.

In some embodiments, each sliding clamp of the two sliding clamps includes a nut and a bolt.

In some embodiments, each sliding clamp of the two sliding clamps includes a nut, a bolt, and two block sliders each having a bolt hole. In further embodiments, the nut is a wing nut.

In some embodiments, the nut is cooperative with a bolt of the sliding clamp such that when the nut is tightened so as to prevent the block slider from sliding along the slotted beams, the slotted beams are also pulled together, thereby trapping the framing square between the two slotted beams, which serves to secure the framing square in a desired position and orientation.

In some embodiments, each slotted beam of the pair of slotted beams is shaped as a structural channel, and each block slider moves inside and along the structural channel.

In some embodiments, slotted beam of the pair of slotted beams is shaped as a structural channel, each structural channel having a back side, the back sides of the structural channels being pressed together by at least one sliding clamp so as to trap the framing square between the back sides of the two slotted beams, thereby securing the framing square in a desired position and orientation.

In some embodiments, each block slider of the two sliding clamps includes one of: an alignment peg and an alignment peg hole, the alignment peg being cooperative with the alignment peg hole so as to maintain the block slider in substantial parallel alignment with the inside of the structural channel of each slotted beam.

Another general aspect of the invention is a framing tool including: a pair of slotted beams each having a first end and a second end, each slotted beam having one or more slots; a pair of end spacers, one end spacer being sandwiched between the pair of slotted beams at each end, each end spacer being of a thickness configured to maintain a fixed separation distance at each end of the pair of slotted beams substantially similar to a thickness of a framing square; a pair of end-fixed spacer assemblies, a first end-fixed spacer assembly being configured to squeeze together the first ends against an end spacer of the pair of end spacers, and a second end-fixed spacer assembly being configured to squeeze together the second ends against an end spacer of the pair of end spacers; and two sliding clamps, a first sliding clamp being slidable along a slot of the pair of slotted beams, a second sliding clamp being slidable along a slot of the pair of slotted beams, each sliding clamp being configured to be able to squeeze the two slotted beams together so as to trap the framing square between the two slotted beams.

In some embodiments, each slotted beam of the pair of slotted beams is shaped as a structural channel, each structural channel having a back side, the back sides of the structural channels being pressed together by at least one sliding clamp so as to trap the framing square between the back sides of the two slotted beams, thereby securing the framing square in a desired position and orientation.

In some embodiments, each end spacer of the pair of end spacers includes a bolt hole, and each slotted beam includes a bolt hole at each of the first and second ends thereof.

In some embodiments, the framing tool further includes: a first bolt extending through the bolt hole of a first end spacer, and through a bolt hole in a first end of each slotted beam of the pair of slotted beams; a first nut cooperative with the first bolt, the first nut being configured to press each of the first ends against the first end spacer; a second bolt extending through the bolt hole of a second end spacer, and through a bolt hole in a second end of each slotted beam of the pair of slotted beams; and a second nut cooperative with the second bolt, the second nut being configured to press each of the second ends against the second end spacer.

In some embodiments, each sliding clamp of the two sliding clamps includes a wing nut, and a bolt.

In some embodiments, each sliding clamp of the two sliding clamps includes a wing nut, a bolt, and two block sliders each having a bolt hole.

In some embodiments, the wing nut is cooperative with a bolt of the sliding clamp, such that when the wing nut is tightened so as to prevent the block slider from sliding along the slotted beams, the slotted beams are also pulled together, thereby trapping the framing square between the two slotted beams, which serves to secure the framing square in a desired position and orientation.

In some embodiments, each slotted beam of the pair of slotted beams is shaped as a structural channel, and each block slider moves inside and along the structural channel.

In some embodiments, each block slider of the two sliding clamps includes one of: an alignment peg and an alignment peg hole, the alignment peg being cooperative with the alignment peg hole so as to maintain the block slider in substantial parallel alignment with the inside of the structural channel of each slotted beam.

DETAILED DESCRIPTION

Figure 1:
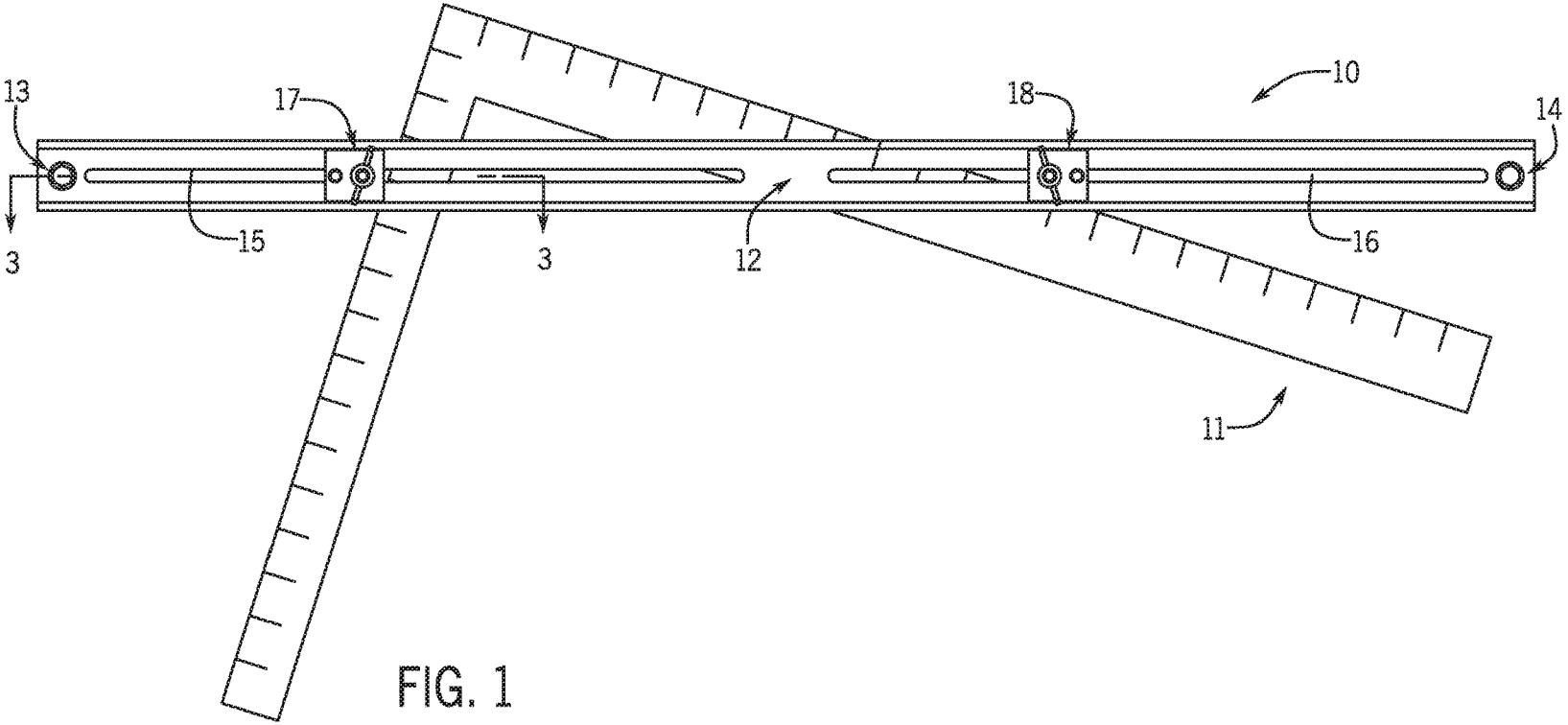
FIG. 1 is a top view of a framing square inserted into an embodiment of the framing tool of the invention.

With reference to FIG. 1, a top view of an embodiment of the framing tool 10 is shown. The framing tool is advantageously used with a framing square (also called a "carpenter's square") 11. The framing tool 10 has a pair of slotted beams 12. Each slotted beam 12 can be between 24 inches to 40 inches long. Each slotted beam 12 being 32 ¾ inches long works particularly well. The slotted beams 12 are affixed together at a fixed separation distance at each end using a first end-fixed spacer assembly 13 and a second end-fixed spacer assembly 14, respectively. A framing square 11 is shown placed between the pair of slotted beams 12. The pair of slotted beams 12 maintain a separation between and all along the beams that allows a particular selected framing square 11 to slide easily but snugly between the two slotted beams 12. In some embodiments, the slotted beams 12 can have a first slot 15 and a second slot 16.

To firmly hold the framing square 11 between the slotted beams 12 at a selected position and angle, two sliding clamps are shown, i.e., a first sliding clamp 17 and a second sliding clamp 18. The first sliding clamp 17 is slidable along the first slot 15, and the second sliding clamp 18 is slidable along the second slot 16, with each sliding clamp 17 and 18 being configured to be able to squeeze the two slotted beams 12 together so as to trap the framing square 11 between the two slotted beams 12.

The slotted beams 12 can be made from extruded aluminum, wood, steel, or plastic, for example.

Figure 2:
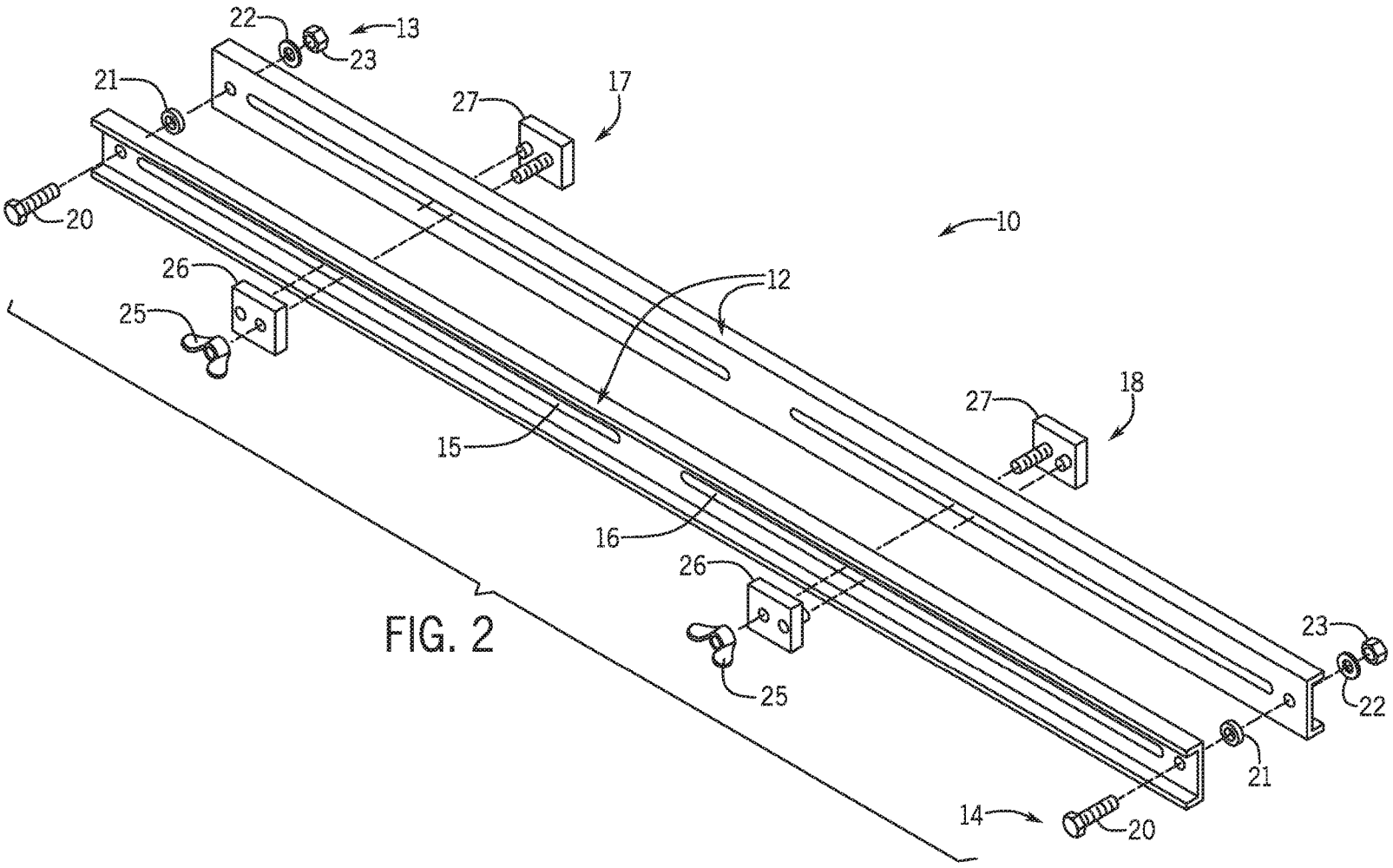
FIG. 2 Is an exploded view of the framing tool of FIG. 1.

Referring to FIG. 2, an exploded view of the framing tool 10 is shown. In this embodiment, the pair of slotted beams 12 are shown in an exploded view to show a first slot 15 and a second slot 16 in each slotted beam 12. The first end-fixed spacer assembly 13 and second end-fixed spacer assembly 14 are shown with their component parts. This embodiment of an end-fixed spacer assembly includes first bolt 20, first annular end spacer 21, first washer 22, and first nut 23. The first end-fixed spacer assembly 13 is configured to squeeze together the first ends of the pair of slotted beams 12 by tightening the first nut 23 on the first bolt 20 to provide tightening pressure against the first annular end spacer 21. The tightened first nut 23 and first bolt 20 provide tightening pressure to hold the first ends of the first pair of slotted beams 12 at a desired fixed distance, which is the thickness of the first annular washer 21. In this embodiment, the second end-fixed spacer assembly 18 is assembled to hold the second ends of the pair of slotted beams 12 at a desired fixed distance in the same way.

The first sliding clamp assembly 17 and the second sliding clamp assembly 18 are shown with their component parts. This embodiment of the sliding clamps includes first wing nut 25, first block slider 26, and first (opposing) block slider 27. The exploded view of FIG. 2 shows the alignment of the first block sliders 26 and 27 with the first slot 15 in the slotted beams 12. This alignment facilitates easy placement of the block sliders 26 and 27 inside and along the slotted beams 12.

Figure 3:
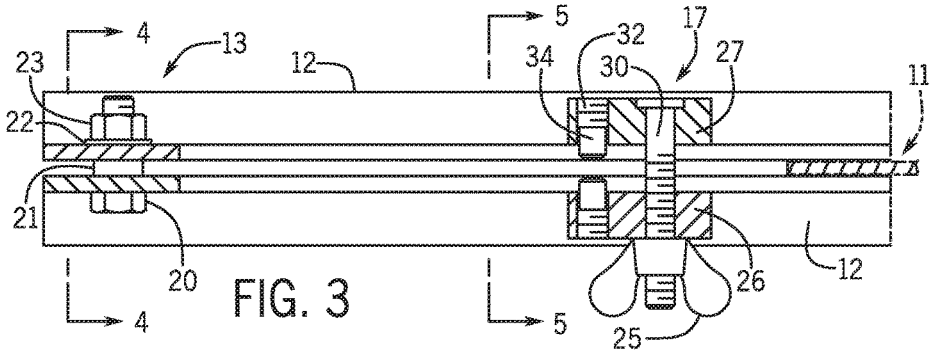
FIG. 3 Is a side view showing one of two end-fixed spacer assemblies, and one of two sliding clamp assemblies.

Referring to FIG. 3, a side view shows one of two end-fixed spacer assemblies 13, and one of two sliding clamp assemblies 17. The two slotted beams 12 are affixed together by end-fixed spacer assembly 13, which can include end bolt 20, annular end spacer 21, washer 22, and nut 23. The two slotted beams 12 are squeezed together along their length against a framing square 11 by bolt 20 and nut 23, while the two slotted beams 12 are held apart at a fixed distance at each end by an annular end spacer 21 at each end.

Each annular end spacer 21 is of a thickness selected to maintain the two slotted beams 12 at a separation all along the beams that allows the framing square 11 to slide easily but snugly between the two slotted beams 12.

One of two slotted sliding clamps 17 is shown configured along the two slotted beams 12. The sliding clamp wing nut 25 and bolt 30 are shown inserted through the block sliders 26 and 27. In preferred embodiments, the block sliders include an alignment peg hole 32 and an alignment peg 34, with the alignment peg 34 being cooperative with the alignment peg hole so as to maintain the block slider in substantial parallel alignment with the inside of the structural channel of each slotted beam 12.

Figure 4:
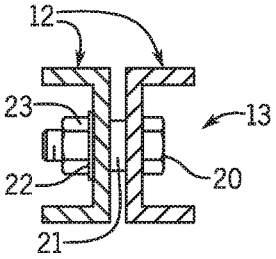
FIG. 4 is an end-on view of the end-fixed spacer assembly of FIG. 3.

Referring to FIG. 4, an end-on view shows the end-fixed spacer assembly 13 of FIG. 3. Also shown are cross-sections of the two slotted beams 12, and the end-fixed spacer assembly 13, which in a preferred embodiment include end bolt 20, annular end spacer 21, washer 22, and nut 23.

Figure 5:
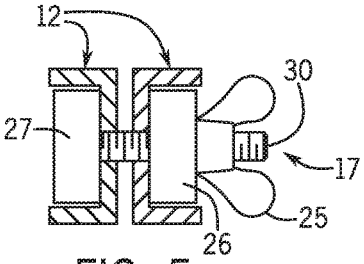
FIG. 5 is an end-on view of the sliding clamp assembly of FIG. 3.

Referring to FIG. 5, an end-on view shows the sliding clamp assembly 17 of FIG. 3. Shown are cross-sections of the two slotted beams 12, and the sliding clamp assembly 17, which in a preferred embodiment includes a wing nut 25, and two block sliders 26 and 27.

Figure 6:
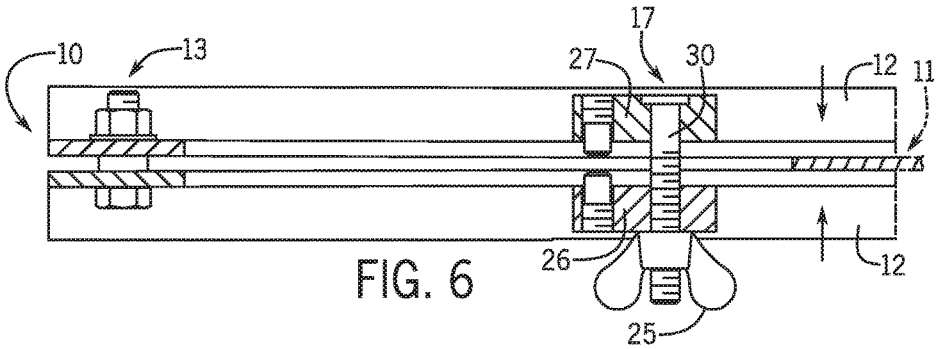
FIG. 6 is a side view showing the end-fixed spacer assembly, and the sliding clamp assembly of FIG. 3 cooperating so as to trap a framing square between the two slotted beams of the framing tool.

Referring to FIG. 6, a side view shows the end-fixed spacer assembly 13, and the sliding clamp assembly 17 of FIG. 3, cooperating so as to trap a framing square 11 between the two slotted beams 12 of the framing tool 10. In a preferred embodiment, tightening the wing nut 25 on the bolt 30 prevents the block sliders 26 and 27 from sliding along the slotted beams 12, and the slotted beams 12 are pulled together so as to secure the framing square 11 in a desired position and orientation. This cross-sectional view shows that when tightening pressure is applied by wing nut 25 to the sandwiched framing square 11 to the right of the sliding clamp assembly 17, the framing square is trapped and maintained in place as needed, until the wing nut 25 is loosened, thereby releasing at least a portion of the framing square 11.

Other modifications and implementations will occur to those skilled in the art without departing from the spirit and the scope of the invention as claimed. Accordingly, the above description is not intended to limit the invention, except as indicated in the following claims.

What is claimed is:

1. A framing tool comprising:

a pair of slotted beams each having a first end and a second end, each slotted beam having one or more slots;

a pair of end spacers, one end spacer being sandwiched between the pair of slotted beams at each end, each end spacer being of a thickness configured to maintain a separation distance at each end of the pair of slotted beams substantially similar to a thickness of a framing square; and two sliding clamps, a first sliding clamp being slidable along a slot of the pair of slotted beams, a second sliding clamp being slidable along a slot of the pair of slotted beams, each sliding clamp being configured to be able to squeeze the two slotted beams together so as to trap the framing square between the two slotted beams.

2. The framing tool of claim 1, wherein each end spacer of the pair of end spacers includes a bolt hole, and each slotted beam includes a bolt hole at each of the first and second ends thereof, the framing tool further comprising:

a first bolt extending through the bolt hole of a first end spacer, and through a bolt hole in a first end of each slotted beam of the pair of slotted beams;

a first nut cooperative with the first bolt, the first nut being configured to press each of the first ends against the first end spacer;

a second bolt extending through the bolt hole of a second end spacer, and through a bolt hole in a second end of each slotted beam of the pair of slotted beams; and a second nut cooperative with the second bolt, the second nut being configured to press each of the second ends against the second end spacer.

3. The framing tool of claim 2, the framing tool further comprising:

a washer cooperative with each of the first and second nuts.

4. The framing tool of claim 1, wherein each sliding clamp of the two sliding clamps includes a nut and a bolt.

5. The framing tool of claim 1, wherein each end spacer is an annular end spacer.

6. The framing tool of claim 1, wherein each sliding clamp of the two sliding clamps includes a nut, a bolt, and two block sliders each having a bolt hole.

7. The framing tool of claim 6, wherein the nut is a wing nut.

8. The framing tool of claim 6, wherein the nut is cooperative with a bolt of the sliding clamp such that when the nut is tightened so as to prevent the block slider from sliding along the slotted beams, the slotted beams are also pulled together, thereby trapping the framing square between the two slotted beams, which serves to secure the framing square in a desired position and orientation.

9. The framing tool of claim 6, wherein each slotted beam of the pair of slotted beams is shaped as a structural channel, and each block slider moves inside and along the structural channel.

10. The framing tool of claim 1, wherein each slotted beam of the pair of slotted beams is shaped as a structural channel, each structural channel having a back side, the back sides of the structural channels being pressed together by at least one sliding clamp so as to trap the framing square between the back sides of the two slotted beams, thereby securing the framing square in a desired position and orientation.

11. The framing tool of claim 10, wherein each block slider of the two sliding clamps includes one of:

an alignment peg and an alignment peg hole, the alignment peg being cooperative with the alignment peg hole so as to maintain the block slider in substantial parallel alignment with the inside of the structural channel of each slotted beam.

12. A framing tool comprising:

a pair of slotted beams each having a first end and a second end, each slotted beam having one or more slots;

a pair of end spacers, one end spacer being sandwiched between the pair of slotted beams at each end, each end spacer being of a thickness configured to maintain a separation distance at each end of the pair of slotted beams substantially similar to a thickness of a framing square;

a pair of end-fixed spacer assemblies, a first end-fixed spacer assembly being configured to squeeze together the first ends against an end spacer of the pair of end spacers, and a second end-fixed spacer assembly being configured to squeeze together the second ends against an end spacer of the pair of end spacers; and two sliding clamps, a first sliding clamp being slidable along a slot of the pair of slotted beams, a second sliding clamp being slidable along a slot of the pair of slotted beams, each sliding clamp being configured to be able to squeeze the two slotted beams together so as to trap the framing square between the two slotted beams.

13. The framing tool of claim 12, wherein each slotted beam of the pair of slotted beams is shaped as a structural channel, each structural channel having a back side, the back sides of the structural channels being pressed together by at least one sliding clamp so as to trap the framing square between the back sides of the two slotted beams, thereby securing the framing square in a desired position and orientation.

14. The framing tool of claim 12, wherein each end spacer of the pair of end spacers includes a bolt hole, and each slotted beam includes a bolt hole at each of the first and second ends thereof.

15. The framing tool of claim 14, the framing tool further comprising:

a first bolt extending through the bolt hole of a first end spacer, and through a bolt hole in a first end of each slotted beam of the pair of slotted beams;

a first nut cooperative with the first bolt, the first nut being configured to press each of the first ends against the first end spacer;

a second bolt extending through the bolt hole of a second end spacer, and through a bolt hole in a second end of each slotted beam of the pair of slotted beams; and a second nut cooperative with the second bolt, the second nut being configured to press each of the second ends against the second end spacer.

16. The framing tool of claim 12, wherein each sliding clamp of the two sliding clamps includes a wing nut, and a bolt.

17. The framing tool of claim 12, wherein each sliding clamp of the two sliding clamps includes a wing nut, a bolt, and two block sliders each having a bolt hole.

18. The framing tool of claim 17, wherein the wing nut is cooperative with a bolt of the sliding clamp, such that when the wing nut is tightened so as to prevent the block slider from sliding along the slotted beams, the slotted beams are also pulled together, thereby trapping the framing square between the two slotted beams, which serves to secure the framing square in a desired position and orientation.

19. The framing tool of claim 17, wherein each slotted beam of the pair of slotted beams is shaped as a structural channel, and each block slider moves inside and along the structural channel.

20. The framing tool of claim 17, wherein each block slider of the two sliding clamps includes one of:

an alignment peg and an alignment peg hole, the alignment peg being cooperative with the alignment peg hole so as to maintain the block slider in substantial parallel alignment with the inside of the structural channel of each slotted beam.

* * * * *